United States Patent [19]

Ball et al.

[11] Patent Number: 4,759,450

[45] Date of Patent: Jul. 26, 1988

[54] OFFICE PAPER AND THE LIKE STORAGE AND HANDLING SYSTEM

[75] Inventors: Douglas C. Ball, Quebec, Canada; Roland A. Mentessi, North Royalton, Ohio; Anthony S. Copeland, Montreal, Canada

[73] Assignee: Hauserman, Inc., Cleveland, Ohio

[21] Appl. No.: 935,707

[22] Filed: Nov. 28, 1986

[51] Int. Cl.[4] ..... A47F 5/00

[52] U.S. Cl. ..... 211/50; 211/90; 211/126

[58] Field of Search ..... 211/90, 126, 133, 118, 211/88, 50, 193, 189; 108/108

[56] References Cited

U.S. PATENT DOCUMENTS

| | | | |
|---|---|---|---|
| 3,701,325 | 10/1972 | Fenwick | 108/108 X |
| 4,126,230 | 11/1978 | Tyson et al. | 211/50 |
| 4,415,091 | 11/1983 | Wolff | 211/50 |
| 4,605,988 | 8/1986 | Nienhuis et al. | 211/126 X |

FOREIGN PATENT DOCUMENTS

| | | | |
|---|---|---|---|
| 1127556 | 4/1962 | Fed. Rep. of Germany | 211/90 |
| 183973 | 4/1963 | Sweden | 211/90 |
| 1068579 | 5/1967 | United Kingdom | 211/90 |

*Primary Examiner*—Robert W. Gibson, Jr.

*Attorney, Agent, or Firm*—Renner, Otto, Boisselle & Lyon

[57] ABSTRACT

An assembly for supporting and storing paper, reference materials and other like items on a space divider and furniture system off of work surfaces includes paired hanging vertically extending brackets having one or more horizontally projecting cantilevered arms. Each bracket includes an upper hook and alternative forms of a lower foot which maintains the brackets vertical and the arms horizontal. The hook and feet are removably secured to the ends of the brackets and the alternative feet are employed depending on the height at which the assembly is mounted on the space divider system. The brackets may be mounted anywhere along the space divider system. The arms in turn support with a snap fit several forms or sizes of molded plastic trays which interconnect the paired brackets. The arms are circular in section and the edges of the tray are provided with downwardly turned circular edges which snap over the arms. Projections partially closing such openings assist in retaining the trays on the arms. The trays are molded with a grid of slots and holes to receive and support snap-in zig-zag wire forms which may be used as tray back stops or to subdivide the trays to handle a variety of paper sizes or other items.

29 Claims, 4 Drawing Sheets

OFFICE PAPER AND THE LIKE STORAGE AND HANDLING SYSTEM

This invention relates generally as indicated to an office paper and the like storage and handling system and more particularly to an assembly for storing paper, reference materials and other like items off of work surfaces in a space divider and furniture system.

BACKGROUND OF THE INVENTION

Open office space divider and furniture systems have become widely used in modern offices because of adaptability and flexibility. One of the most successful in terms of performance and flexibility in the electronic office is the space divider and furniture system sold by Sunar Hauserman Inc. of Cleveland, Ohio under the trademark RACE. Such system is shown in copending application Ser. No. 791,357, filed Oct. 25, 1985, and comprises a unique beam and post system at any position along which work tops may be wholly or partially mounted. The beam includes two superimposed electrical raceways, both at work surface height, with the uppermost raceway for communication wiring being laterally enlarged and having a rounded edge or top corner. Above the raceways there is provided a reticulate frame structure which includes back-to-basic horizontal angles supporting primarily accoustic and visual pads. The angles are thus structurally dissimilar from the raceway at the top of the beam.

Such space divider system is designed primarily for performance and flexibility in the modern electronic office. However, as the use of computer technology grows and the volume of printed information it generates increases, the problem of managing the flow and storage of paper, often in less space, becomes severe. There then is a need in such modern open office space divider and furniture systems to take paper and reference materials off the work surface and store them efficiently within easy reach. Accordingly a paper handling and storage facility for such systems should be usable at any location along the system, able to handle normal functional loads in the office, have few parts, and yet have the ability to be customized to suit particular applications, and also be fully visually and functionally compatible with the system.

SUMMARY OF THE INVENTION

An assembly for supporting and storing paper, reference materials and other like items on a space divider and furniture system off of work surfaces includes paired hanging vertically extending brackets having one or more horizontally projecting cantilevered arms. Each bracket includes an upper hook and alternative forms of a lower foot which maintains the brackets vertical and the arms horizontal. The hook and feet are removably secured to the ends of the brackets and the alternative feet are employed depending on the height at which the assembly is mounted on the space divider system. The brackets may be mounted anywhere along the space divider system. The arms in turn support with a snap fit several forms or sizes of molded plastic trays which interconnect the paired brackets. The arms are circular in section and the edges of the tray are provided with downwardly turned circular edges which snap over the arms. Projections partially closing such openings assist in retaining the trays on the arms. The trays are molded with a grid of slots and holes to receive and support snap-in zig-zag wire forms which may be used as tray back stops or to subdivide the trays to handle a variety of paper sizes or other items.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 9 is a front view of a single tray embodiment of the present invention which may be used to store binders, books or the like;

DETAILED DESCRIPTION OF THE PREFERRED EMBODIMENTS

Figures 1, 2, 3, 4:
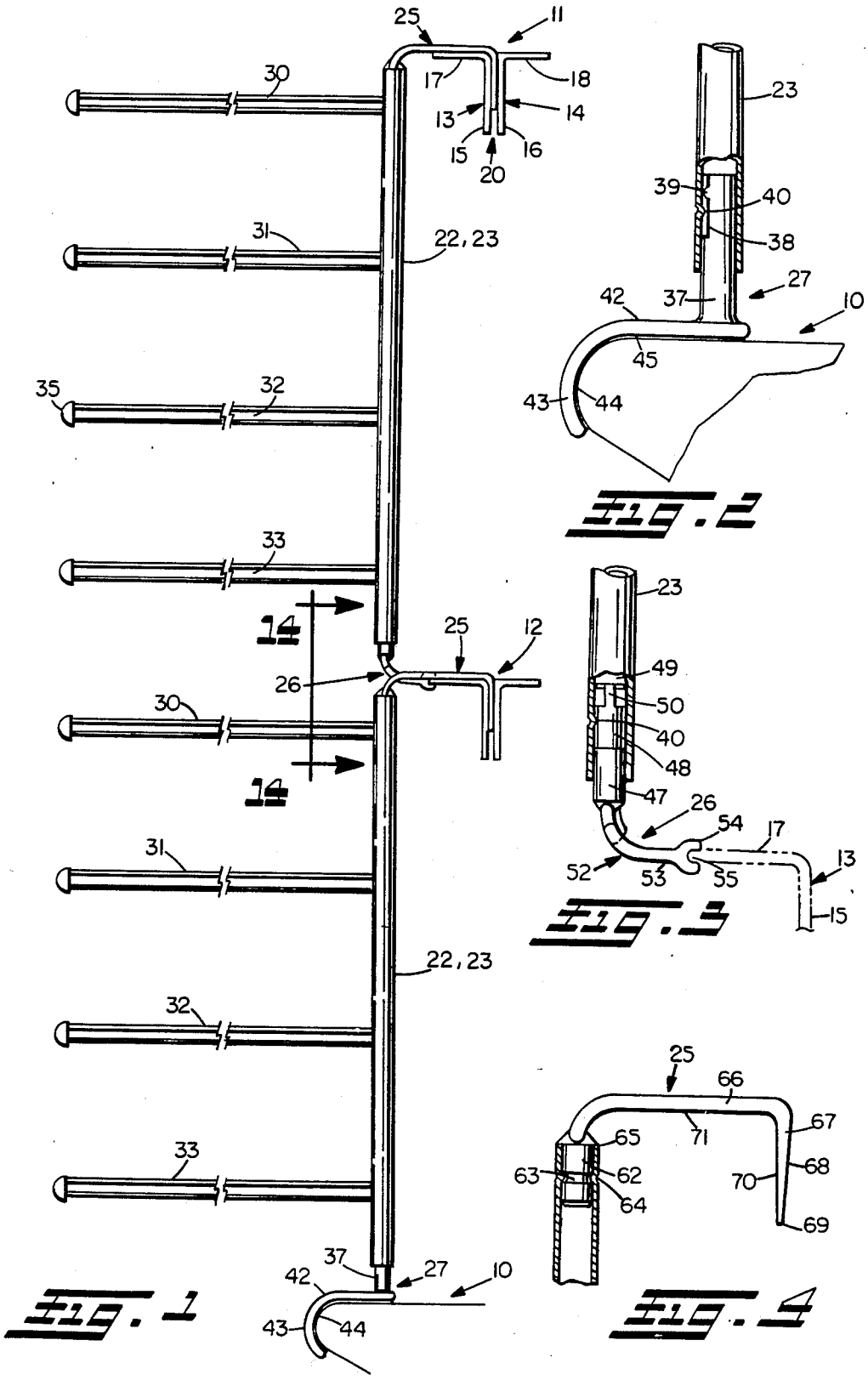
FIG. 1 is a side view of two paper handling bracket assemblies one above the other in accordance with the present invention mounted on a space divider system.
FIG. 2 is an enlarged fragmentary partially broken away side view of one form of foot.
FIG. 3 is a similar fragmentary partially broken away side view of another form of foot.
FIG. 4 is a similar fragmentary partially broken away side view of the hook.

Referring first to FIG. 1 there is partially illustrated a space divider system with which the paper handling and storage system of the present invention is used. As indicated, the space divider and furniture system illustrated is sold by Sunar Hauserman Inc. of Cleveland, Ohio under the trademark RACE and such system is shown in greater detail in copending application Ser. No. 791,357 filed Oct. 25, 1985. The system comprises a unique beam indicated generally at 10 which is supported on a post system. Above the beam there is provided a reticulate frame system primarily for supporting accoustic and visual pads, such frame system comprising vertically spaced and horizontally extending back-to-back angle assemblies seen generally at 11 and 12. Each back-to-back angle assembly includes angles 13 and 14 which include back-to-back vertical legs 15 and 16 and top outwardly extending horizontal legs 17 and 18. The back-to-back angles provide a vertical slot seen at 20 therebetween. The back-to-back angles are supported by posts (not seen) from the top of the beam 10.

The office paper and like storage and handling system includes a pair of vertically extending tubular brackets, each of which includes a hook 25 at the top, and either of two forms of a foot at the bottom as seen at 26 and 27. The form of foot employed depends upon the position of the brackets on the space divider system. If the brackets are supported from the upper of the back-to-back angle assemblies the form of foot 26 will be employed. If the brackets are supported from the lower of the back-to-back angle assemblies as seen at 12, the form of foot 27 will be employed.

Each of the brackets in the form illustrated in FIGS. 1 and 5–8 may include four horizontally extending arms projecting in cantilever fashion from the brackets as seen at 30, 31, 32 and 33. Such arms are equally spaced vertically along the bracket and are of circular section. Also, the tip of each arm is provided with a spherical nose for appearance, retention of the trays and to avoid sharp edges as indicated at 35. Although four arms are illustrated, it will be appreciated that the number may vary. For example, two arms on each brackets may be provided.

Figure 13:
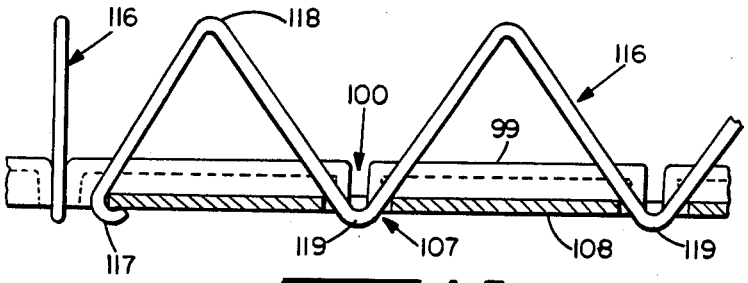
FIG. 13 is a fragmentary vertical section of the tray of FIG. 11 showing zig-zag wire forms mounted therein.
Figure 11:
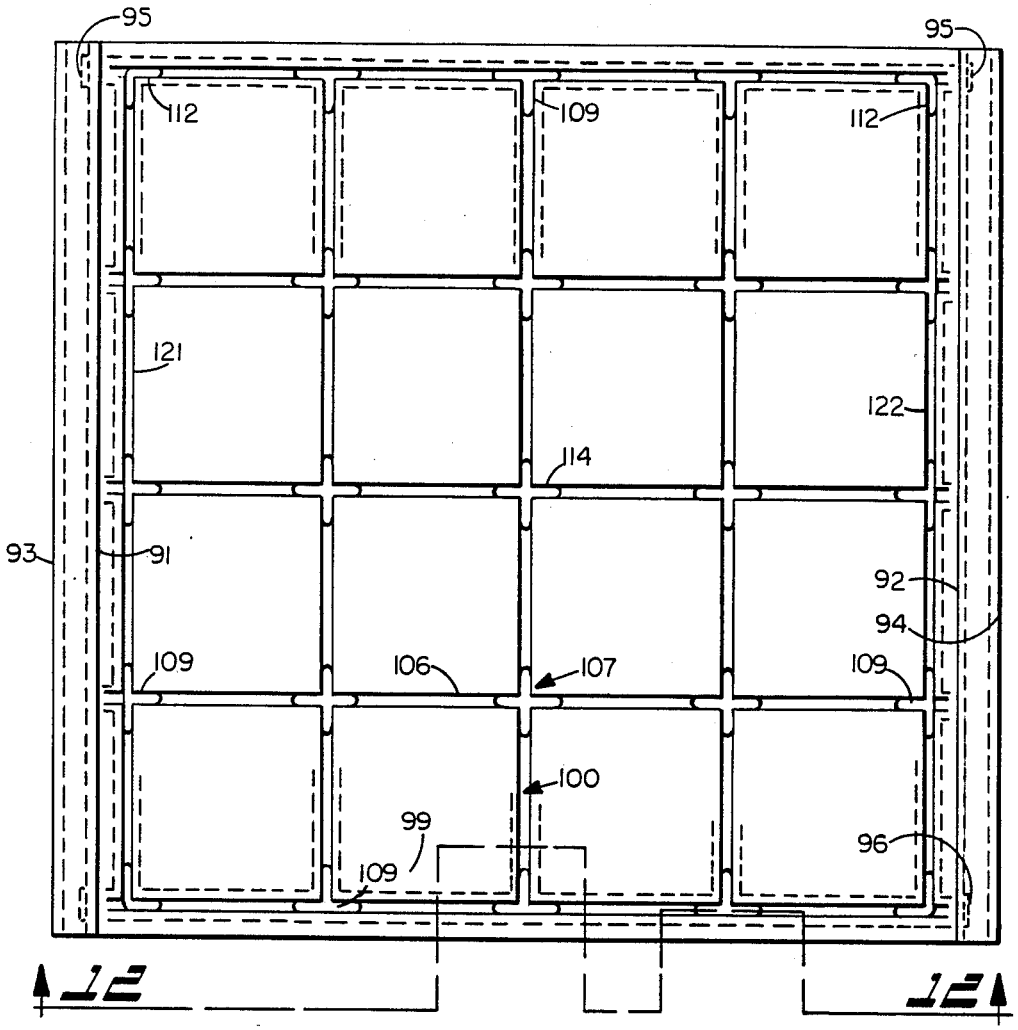
FIG. 11 is a top plan view of a tray in accordance with the present invention.
Figure 12:
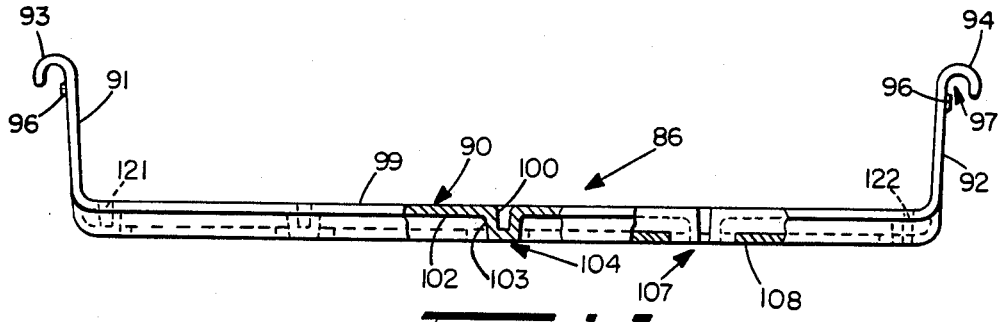
FIG. 12 is a front elevation partially broken away of the paper tray of FIG. 11 taken along line 12—12 thereof.

When the brackets are positioned vertically on the space divider system the arms of the respective brackets may be interconnected by molded plastic trays of several different types and sizes as seen in FIGS. 5–8, such trays being shown in detail in FIGS. 11, 12 and 13. Such molded plastic trays will hereinafter be described in detail.

Referring now to FIG. 2 it will be seen that the foot 27 is utilized in association with the beam 10 and includes a leg 37 which telescopes within the bottom of the bracket 23. The leg is circular in section and includes an axially extending slot 38 which is provided with a detent projection 39. When the leg is telescoped within the bottom end of the bracket, the detent projection snaps over dimple 40 formed in the wall of the bracket releasably locking the leg in place. The dimple 40 interfitting with the groove 38 prevents the foot from rotating with respect to the axis of the bracket but nonetheless permits limited relative axial movement.

The leg terminates in a foot 42 which projects horizontally forwardly and which itself terminates in a rounded edge or hook portion 43 which closely conforms to the rounded corner 44 of the beam 10. The bottom or inside surface of the foot 42 may be provided with urethane rubber layer 45 held to the foot by a pressure sensitive adhesive which keeps the foot from slipping with respect to the beam surface one the foot is properly positioned. In any event the foot 27 may readily be removed from and placed on the bottom of the tubular brackets 22 or 23. The foot 27 may be of molded plastic while the tubular brackets 22 or 23 may be steel tubing.

Figure 14:
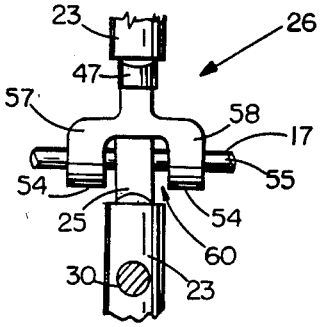
FIG. 14 is a fragmentary front elevation seen from the line 14—14 of FIG. 1 illustrating the bifurcated foot enabling the brackets to be positioned vertically one abaove the other.

Referring now to FIGS. 3 and 14, the form of foot 26 illustrated includes a shank 47 which includes a fairly long circumferential groove 48 which communicates with the end 49 of the shank through relatively narrow slot 50. Both the slot 50 and the groove 48 cooperate with dimple 40 near the bottom of the bracket. In this manner the shank 47 of the foot 26 may be inserted in a position initially at align the simple with the narrow groove 50. When the dimple is in communication with the wide circumferential groove 48, the foot may be turned 90°. The foot however is free to move axially the axial extent of the circumferential groove 48. Extending downwardly and inwardly from the shank is a bifurcated or symmetrically forked arm 52, each fork of which curves inwardly to a horizontal extent seen at 53 and terminates in a C-shape end 54. The interior of the C-shape end is designed to embrace the edge 55 of the horizontal leg 17 of the angle 13. The bifurcated legs are shown at 57 and 58 in FIG. 14 and such bifurcation leaves an opening 60 therebetween which accommodates hook 25 supporting a tubular bracket 23 directly below the bracket 23 thereabove. In this manner brackets may be vertically aligned.

It should be noted that both forms of feet 26 and 27 are free to move vertically in the bottom end of the bracket and are not weight supporting structures. Accordingly, the foot 26 engages the edge 55 of the vertical 13 with a horizontal force only. Similarly, the bracket 23 does not transmit a vertical force to the foot 27. The purpose of the feet is simple to maintain the brackets in a vertical position even when the arms are under load. In the case of both feet, the vertical loading will be towards the center of the space divider system.

The hook 25 seen in FIG. 4 is removably secured to the top of the brackets 22 or 23 and includes a shank 62 which fits within the top of the bracket 23. The shank includes an annular groove indicated at 63 which cooperates with a plurality of dimples 64 in the wall of the bracket to hold the shank releasably in the top of the bracket. The position of the slot and dimples is such that there is no clearance or vertical jiggle between the enlarged top of the shank and the top of the bracket as indicated at 65. From such enlarged top the hook curves to a horizontal rather thick portion 66 as then terminates in a vertically downwardly extending portion 67, the outer wall 68 of which tapers slightly to tip 69. The inner wall 70 is vertical. The underside of the horizontal portion as indicated at 71 may be provided with a layer of urethane rubber to prevent movement once the bracket with the hook thereon is in the selected position along the back-to-back angles.

Figure 5:
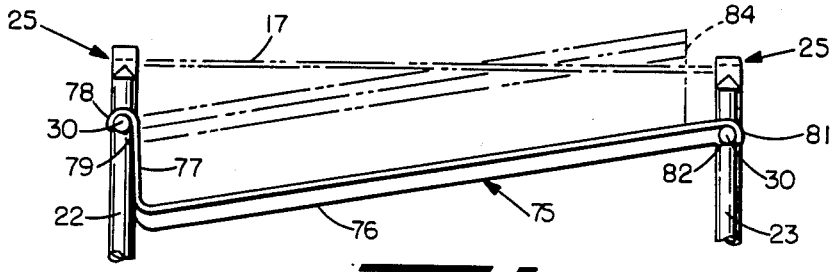
FIG. 5 is a partial front view of a bracket assembly made in accordance with the present invention having mounted thereon one form of paper tray.
Figure 6:
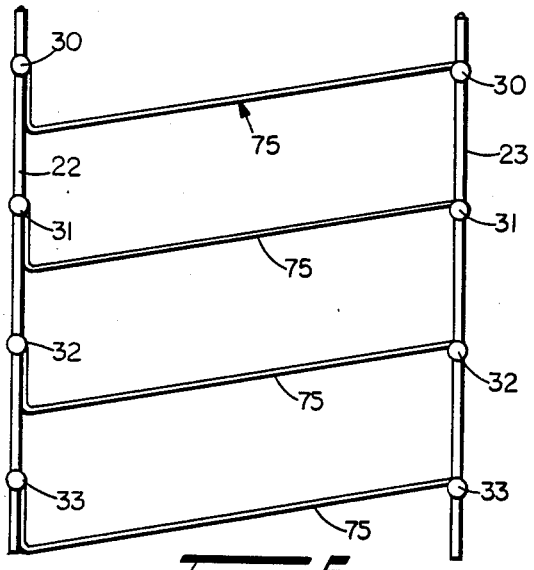
FIG. 6 is a full front view of the bracket assembly of FIG. 5 having paper trays mounted on all of the arms.

Referring again to FIGS. 5–7 will be seen that the brackets 22 and 23 are designed to be used in pairs and that the horizontal spacing between each bracket of a pair may be varied depending upon the size of molded plastic tray positioned on the arms. FIGS. 5 and 6 illustrate one type of tray 75. Tray 75 includes an inclined bottom 76 and one vertical side wall 77. The side wall 77 is provided with a downwardly opening circular edge 78. The exterior of the wall 77 just below the circular edge is provided with short projections 79 which partially close the opening of the edge to facilitate the snap connection of the circular edge with the cantilevered or projecting rod arm 30. The inclined bottom at the opposite side of the tray also includes a downwardly opening circular edge. Again the bottom is provided with projections 82 partially closing the opening to facilitate the retention of the edge on the arm 30 when snapped in place. When the tray is snapped in place on the arms of the respective brackets 22 and 23, it will be seen that the brackets are then held together by the trays in the paired arrangement. It should be noted that the inclined trays may snap on the bracket arms in either a right or left handed attitude and that the arms don't have to be horizontally aligned.

As seen in FIG. 6, four such trays may be positioned on the arms 30 of the brackets 22 and 23 to provide inclined paper trays which are open on the righthand side of FIGS. 5 and 6. Such paper handling system may be used, for example, to store various paper sizes for copy machines or printers. A paper stack is illustrated in phantom lines at 84 in FIG. 5.

Figure 8:
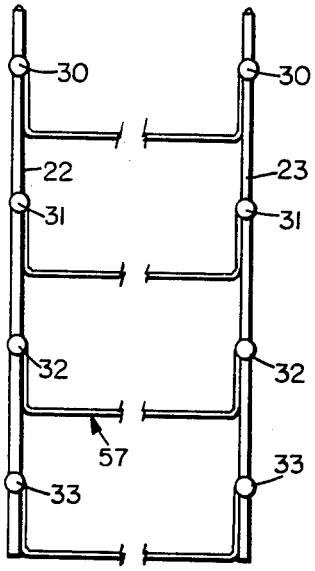
FIG. 8 is a similar view showing yet another type of paper tray.
Figure 7:
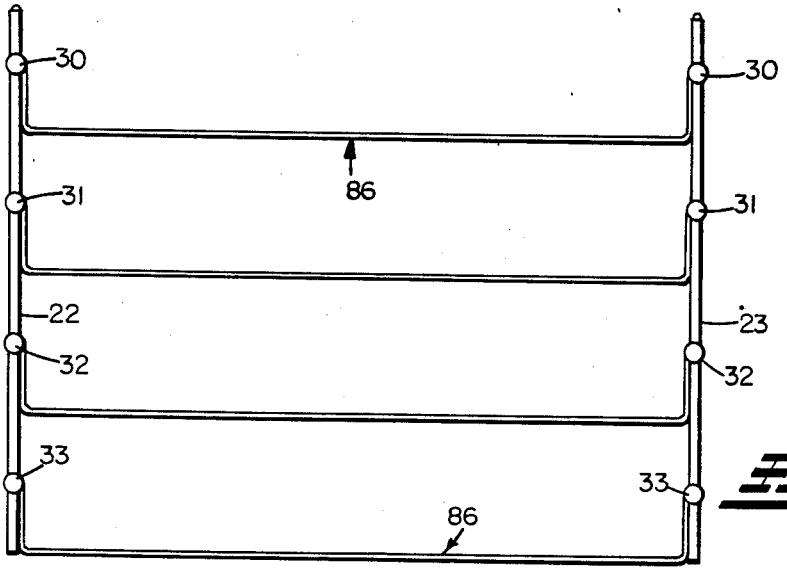
FIG. 7 is a similar view showing another type of paper tray.

The paper trays 86 and 87 illustrated in FIGS. 7 and 8, respectively, are of a slightly different type. The trays of FIGS. 7 and 8 may differ only in their leg to leg width. Intermediate sizes may also be provided. The details of the paper tray are shown in FIGS. 11–13.

Referring now additionally to such Figures it will be seen that the trays include a bottom 90 and side walls 91 and 92 which at the tops thereof are provided with downwardly opening circular edges 93 and 94, respectively. The walls 91 and 92 are provided with projections seen at 95 and 96 just below the downturned opening 97 to assist to retaining the tray on the arms when snapped in place.

The bottom of the tray 90 includes a major supporting surface 99 in which is provided a reticulate arrangement of slots 100. The wall 102 forming the surface 99 extends downwardly around the slots as indicated at 103 forming downwardly projecting ridges 104 having the same reticulate pattern as the slots. At the intersection of the slots there are provided apertures as indicated generally at 107 which extend through the bottom wall 108 of such slots. The apertures are of three different configurations As indicated more clearly in FIG. 11, at the top, bottom, right and lefthand sides, the apertures are T-shape as seen at 109 with the stem of the T extending away from the sides, front or back. At the corners of the tray the apertures are L-shape as seen at 112. The other apertures are in effect cross shaped or in the form of a plus sign as seen at 114.

The reticulate slot and ridge arrangement serves two purposes. One purpose is to rigidify the bottom of the tray and the other purpose is to assist in placement and retention of zig-zag wire forms seen at 116 in FIG. 13. As illustrated, the zig-zag wire forms 116 includes hooks 117 on the ends and acute angle top bends 118 and similarly acute angle bottom bends 119. With the hole and slot arrangement illustrated, the zig-zag wire forms may be inserted to extend in any slot from side to side of the tray and from front to back of the tray. In this manner the cross shape apertures 114 receive the bottom bend of the wire form 119 permitting the same to project slightly below the bottom of the tray and the wire form is supported in the upright position by the walls of the apertures as well as the walls of the slots. The hooks 117 project slightly through the bottom of the tray as indicated.

If the wire form is placed at the back of the tray (top of FIG. 11) it acts as a backstop. If the wire forms are used at the sides in the slots 121 and 122, they effectively increase the side wall height.

In the inclined tray as seen in FIGS. 5 and 6 the front to back slots and holes are vertical so that the wire forms supported thereby will also be vertical or parallel to the one side wall 77.

Obviously, the trays may vary in width depending upon the items to be supported. Wider trays may for example support legal size paper while the more narrow trays of FIG. 8 may be employed to support computer discs, for example. Also, instead of the four arms on each bracket and four trays, it will be appreciated that, for example, only two arms and two trays may be provided on each bracket.

Figure 9:
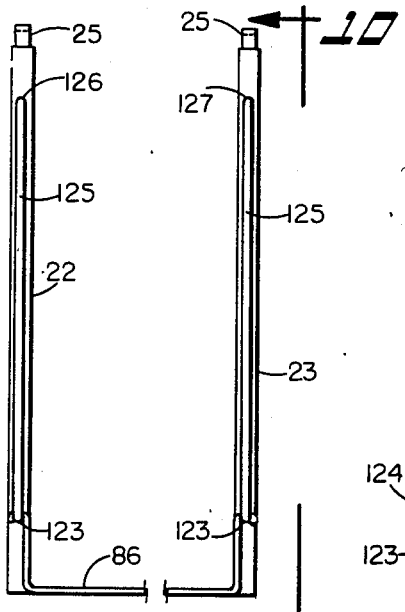
Figure 10:
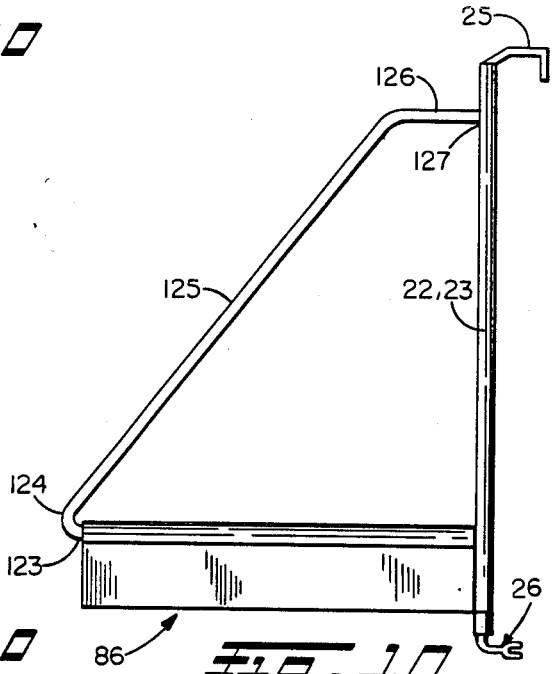
FIG. 10 is a side view of the embodiment of FIG. 9 as seen from the line 10—10 thereof.

For heavier or perhaps taller items such as brooks or ring binders, a bracket assembly such as seen in FIGS. 9 and 10 may be provided. The brackets 22 and 23 are similarly supported by hooks 25 at the top and feet 26 at the bottom engaging the horizontally extending back-to-back angles. Instead of a plurality of cantilevered arms, each bracket is provided with an arm which extends out horizontally as indicated at 123 from near the bottom of the brackets, such arm at its distal end then being bent backwardly at the rounded acute angle 124 to extend upwardly in slant fashion as seen at 125, then to extend horizontally as shown at 126 to be attached again at 127 near the top of the bracket. The tray 86 is then snapped onto the major horizontal extent 123 of such arms and the tray may then act as a shelf for supporting books, ring binders and the like, with the arm configuration holding the contents upright. Again, the tray may be divided as desired by the wire forms.

It can now be seen that with relatively few parts a variety of forms of paper handling or storage modules may be constructed. The snap-in dividers and the snap-on trays provide office workers the ability to customize components to suit particular applications. Because of the space divider system and the cooperation between the bracket supporting hooks and feet, the components may be positioned essentially anywhere along the space divider system at the desired height. In fact, the components may be mounted one directly over the other.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A paper handling system for a space divider system comprising a pair of vertically extending brackets, hook means at the top of said brackets adapted to catch and engage such space divider system, foot means at the bottom of said brackets also adapted to mate with and engage said space divider system to maintain said brackets vertical, respective arms extending horizontally from each of said brackets, and tray means mounted on said respective arms spanning said brackets and holding said brackets together as a unitary pair, said arms being in the form of rods and said tray means including circular edges which snap on said arms.

2. A system as set forth in claim 1 wherein said tray means are molded plastic trays and include a grid of wire form receptacles.

3. A system as set forth in claim 1 wherein said tray means include a bottom and only one side wall, and a circular edge at the top of said side wall and at the opposite edge of said bottom which snap on said arms whereby the tray bottom is supported in inclined fashion.

4. A system as set forth in claim 1 wherein said tray means include a bottom and two side walls of equal height, and circular edges at the top of each side wall which snap on said arms whereby the tray bottom is supported horizontally but below horizontally aligned arms.

5. A system as set forth in claim 1 wherein said tray means are of molded plastic and have a bottom which includes a grid of slots adapted to receive and support wire forms.

6. A system as set forth in claim 1 wherein said tray means are of molded plastic and have a bottom which includes a grid of slots, apertures in said bottom at the intersection of said slots, and a zig-zag wire form adapted to be received and supported in said slots and apertures.

7. A system as set forth in claim 1 wherein said arms are in the form of circular section rods and said tray means are of molded plastic and have downwardly opening outturned circular edges adapted to snap on said arms, and projections on said tray means partially closing the opening of said circular edges to retain said tray means on said arms.

8. A system as set forth in claim 1 wherein said brackets comprise vertically extending tubes, and said hook means and foot means are removably secured to said tubes.

9. A paper handling system for a space divider system comprising a pair of vertically extending brackets, hook means at the top of said brackets adapted to engage such space divider system, foot means at the bottom of said brackets also adapted to engage said space divider system to maintain said brackets vertical, respective arms extending horizontally from each of aid brackets, and tray means mounted on said respective arms spanning said brackets and holding the same together as a pair, said hook means comprising a horizontally extending portion adapted to be supported on a horizontal leg of a pair of back-to-back angles, and a downwardly extending portion adapted to be positioned between the vertical legs of such back-to-back angles.

10. A paper handling system for a space divider system comprising a pair of vertically extending brackets, hook means at the top of said brackets adapted to engage such space divider system, foot means at the bottom of said brackets also adapted to engage said space divider system to maintain said brackets vertical, respective arms extending horizontally from each of said brackets, and tray means mounted on said respective arms spanning said brackets and holding the same together as a pair, said foot means including an inwardly extending portion adapted to embrace the edge of a horizontal portion of an angle.

11. A paper handling system for a space divider system comprising a pair of vertically extending brackets, hook means at the top of said brackets adapted to engage such space divider system, foot means at the bottom of said brackets also adapted to engage said space divider system to maintain said brackets vertical, respective arms extending horizontally from each of said brackets, and tray means mounted on said respective arms spanning said brackets and holding the same together as a pair, said inwardly extending portion being symmetrically forked to accommodate a hook means supporting a bracket directly below the bracket supported by said foot means.

12. A paper handling system for a space divider system comprising a pair of vertically extending brackets, hook means at the top of said brackets adapted to engage such space divider system, foot means at the bottom of said brackets also adapted to engage said space divider system to maintain said brackets vertical, respective arms extending horizontally from each of said brackets, and tray means mounted on said respective arms spanning said brackets and holding the same together as a pair, said foot means including a leg which extends downwardly and terminates in a foot which includes a horizontal forwardly extending portion which terminates in a downwardly curved portion.

13. A paper handling system for a space divider system comprising a pair of vertically extending brackets, hook means at the top of said brackets adapted to engage such space divider system, foot means at the bottom of said brackets also adapted to engage said space divider system to maintain said brackets vertical, respective arms extending horizontally from each of said brackets, and tray means mounted on said respective arms spanning said brackets and holding the same together as a pair, said pair of brackets each including horizontally extending arms near the bottom thereof and a diagonal strut extending from the outer ends of said arms to the top of said brackets.

14. A paper handling system for a space divider system comprising a pair of vertically extending brackets, hook means at the top of said brackets adapted to engage such space divider system, foot means at the bottom of said brackets also adapted to engage said space divider system to maintain said brackets vertical, respective arms extending horizontally from each of said brackets, and tray means mounted on said respective arms spanning said brackets and holding the same together as a pair, said foot means being free to move vertically to a limited extent with respect to said brackets.

15. In combination, a space divider system comprising a horizontal beam at substantially work surface height, said beam having a rounded top corner, a superstructure above said beam comprising horizontal frame members adapted to support accoustical pads extending above the beam, said superstructure comprising back-to-back horizontal angles, and a paper handling system comprising a pair of vertically extending brackets, hook means at the top of said brackets operative to engage between said back-to-back angles, foot means at the bottom of said brackets operative to engage either a horizontal edge of said angles or said beam corner to maintain said brackets vertical, arms extending horizontally from each of said brackets, and tray means mounted on said respective arms spanning said brackets and holding the same together as a pair.

16. A system as set forth in claim 15 wherein said arms are in the form of rods and said tray means include circular edges which snap on said arms.

17. A system as set forth in claim 15 wherein said tray means are molded plastic trays and include a grid of wire form receptacles.

18. A system as set forth in claim 15 wherein said tray means include a bottom and only one side wall, and a circular edge at the top of said side wall and at the opposite edge of said bottom which snap on said arms whereby the tray bottom is supported in inclined fashion.

19. A system as set forth in claim 15 wherein said tray means include a bottom and two side walls of equal height, and circular edges at the top of each side wall which snap on said arms whereby the tray bottom is supported horizontally but below horizontally aligned arms.

20. A system as set forth in claim 15 wherein said tray means are of molded plastic and have a bottom which includes a grid of slots adapted to receive and support wire forms.

21. A system as set forth in claim 15 wherein said tray means are of molded plastic and have a bottom which includes a grid of slots, apertures in said bottom at the intersection of said slots, and a zig-zag wire form adapted to be received and supported in said slots and apertures.

22. A system as set forth in claim15 wherein said arms are in the form of circular section rods and said tray means are of molded plastic and have downwardly opening outturned circular edges adapted to snap on said arms, and projections on said tray means partially closing the opening of said circular edges to retain said tray means on said arms.

23. A system as set forth in claim 15 wherein said brackets comprise vertically extending tubes, and said hook means and foot means are removably secured to said tube.

24. A combination as set forth in claim 15 wherein said hook means comprises a horizontally extending portion supported on a horizontal leg of one of said back-to-back angles, and a downwardly extending portion positioned between the vertical legs of said back-to-back angles.

25. A combination as set forth in claim 15 wherein said foot means includes an inwardly extending portion embracing the edge of a horizontal portion of one of said back-to-back angles.

26. A combination as set forth in claim 15 wherein said inwardly extending portion is symmetrically forked to accommodate a hook means supporting a bracket directly below the bracket supported by said foot means.

27. A combination as set forth in claim 15 wherein said foot means includes a leg which extends downwardly and terminates in a foot which includes a horizontally forwardly extending portion which terminates in a downwardly curved portion conforming to said rounded top corner of said beam.

28. A combination as set forth in claim 15 wherein said pair of brackets each includes horizontally extending arms near the bottom thereof and a diagonal strut extending from the outer ends of said arms to the top of said brackets.

29. A combination as set forth in claim 15 wherein said foot means are free to move vertically to a limited extend with respect to said brackets.

* * * * *